US012440744B2

(12) United States Patent
Chen

(10) Patent No.: US 12,440,744 B2
(45) Date of Patent: Oct. 14, 2025

(54) TRAMPOLINE SPRING COVER

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 112 days.

(21) Appl. No.: 18/502,922

(22) Filed: Nov. 6, 2023

(65) Prior Publication Data

US 2025/0144502 A1 May 8, 2025

(51) Int. Cl.

| | |
|---|---|
| ***A63B 71/00*** | (2006.01) |
| ***A63B 5/11*** | (2006.01) |
| ***A63B 21/02*** | (2006.01) |
| ***A63B 21/04*** | (2006.01) |

(52) U.S. Cl.

CPC ..... *A63B 71/0054* (2013.01); *A63B 5/11* (2013.01); *A63B 21/023* (2013.01); *A63B 21/0428* (2013.01); *A63B 2071/009* (2013.01)

(58) Field of Classification Search

CPC ..... A63B 5/11; A63B 21/023; A63B 21/0428; A63B 71/0054; A63B 2071/009

See application file for complete search history.

(56) References Cited

U.S. PATENT DOCUMENTS

| | | | | |
|---|---|---|---|---|
| 3,091,454 A | | 5/1963 | Joney | |
| 5,156,409 A | | 10/1992 | Barnes | |
| 5,385,518 A | * | 1/1995 | Turner | A63B 5/11 482/23 |
| 5,683,314 A | | 11/1997 | Musso | |
| 5,785,613 A | | 7/1998 | Francis | |
| 6,001,045 A | * | 12/1999 | Gift | A63B 5/11 482/28 |
| 6,017,292 A | * | 1/2000 | Gift | A63B 5/11 482/28 |
| 6,193,632 B1 | * | 2/2001 | Steger | A63B 6/02 482/27 |
| 9,278,241 B2 | * | 3/2016 | VanElverdinghe | A63B 5/11 |
| 10,780,334 B2 | * | 9/2020 | Nilsson | A63B 21/023 |

* cited by examiner

*Primary Examiner* — Megan Anderson

(74) *Attorney, Agent, or Firm* — Clement Cheng

(57) ABSTRACT

A trampoline has a frame, legs, a bed, springs, an upper spring cover, and a lower spring cover. The frame is horizontally oriented. The legs attach to the frame and support the frame. The bed is suspended across the frame. The springs are in tension and stretch the bed across the frame. The upper spring cover covers the springs from the frame to the bed and a lower spring cover. The lower spring cover attaches to the upper spring cover at a pad to sheath connection. The pad to sheath connection is on the lower distal end of the upper spring cover. The lower spring cover wraps around a horizontal frame portion of the frame around an outside portion of the horizontal frame portion of the frame.

19 Claims, 7 Drawing Sheets

TRAMPOLINE SPRING COVER

The present invention does not claim priority to an earlier application.

TECHNICAL FIELD

The present disclosure relates to trampoline safety.

DISCUSSION OF RELATED ART

A variety of different trampoline covers and spring connectors have been discussed in United States patents. For example, in U.S. Pat. No. 9,180,328 entitled Trampoline by inventors Jonathan M. Schaffer and Christopher J. Neale, published Nov. 10, 2015, the inventors describe, "A trampoline comprises a trampoline sheet or mat supported around its periphery from a circumextending support structure by spring couplings, preferably a plurality of helical springs, under tension. The trampoline is provided with a net enclosure in which a generally circumextending net is mounted by respective sheaths on a plurality of poles coupled to the Support structure and extending generally upright therefrom. In use, for the greater part of its height, the position of the net corresponds generally to the periphery of the support structure, while lower edge regions of the net are coupled to the periphery of the sheet or mat inboard of the support structure, thereby at least largely preventing a user from falling or treading upon the spring couplings or on an annular pad overlying said couplings, if present".

For example, in U.S. Pat. No. 9,339,676 issued May 17, 2016, entitled Trampoline Or The Like With The Enclosure, by Mark W. Publicover and Donald Strasser, the inventors describe, "A fence surrounds a trampoline and extends above the rebounding surface, reducing the risk of injury. Shock absorption is aided in the preferred embodiment by a support system of independent poles, linked at their tops by a flexible strap or line. An impact anywhere on the fence causes the posts to flex inwardly, absorbing the force. Much of this impact injury is stored in system components and is subsequently returned, helping propel an errant jumper back onto to the rebounding surface. Numerous other embodiments and accessories are also detailed. Similar arrangements are suitable for use with above ground pools".

For example, in U.S. Pat. No. 9,545,532 issued Jan. 17, 2017, entitled Trampoline Accessory Attachment System, by David J. Miller, the inventor describes, "A trampoline accessory attachment system comprises an accessory attachment rail enables attachment of an enclosure, pad, or other accessories to a trampoline".

For example, in U.S. Pat. No. 10,780,334 issued Sep. 22, 2020, entitled Zippered Safety Layer In A Trampoline, by Henrik Nilsson and Tomas Hagel, the inventors describe, "Embodiments of the invention provide a zipper attached safety layer applied between a flexible mat and an edge pad of a trampoline. The safety layer moves with the flexible mat and prevents a user from accidently inserting an appendage into the suspension system (e.g., coiled springs) of the trampoline. Embodiments of the invention further relate to a trampoline comprising such a zippered safety layer and to a method of arranging the safety layer in a trampoline".

For example, in United States patent number 2019/0314679 issued Oct. 17, 2019, entitled Trampoline Wiring Loom And Mat Sensor Attachment System, by McGrane et al., the inventors describe, "A trampoline comprises multiple movement sensors associated with one or more parts of the trampoline which move when the trampoline is bounced on by a user such as the trampoline mat, and an electrical wiring loom which connects to the movement sensors to a controller or a common connector at another end of the wiring loom. Various sensor mount and wiring loom options are described".

For example, in U.S. Pat. No. RE45,182 issued Oct. 7, 2014, entitled Trampoline Enclosure Attachment To Trampoline Mat, by Chris Nelson, the inventor describes, "A way to attach a trampoline enclosure to a trampoline frame is described. This process involving constructing the enclosure with a buttonhole at or near its bottom edge. This buttonhole is designed to receive a spring attachment feature located on the rebounding mat of the trampoline structure. Generally, this spring attachment feature will be the D-ring (or V-ring) that is used to attach the rebounding mat to the springs. The D-ring will pass through the buttonhole and, when connected to a corresponding spring, will securely attach the trampoline enclosure to the trampoline". The disclosures of the above cited references are Incorporated herein by reference.

SUMMARY OF THE INVENTION

A trampoline has a frame, legs, a bed, springs, an upper spring cover, and a lower spring cover. The frame is horizontally oriented. The legs attach to the frame and support the frame. The bed is suspended across the frame. The springs are in tension and stretch the bed across the frame. The upper spring cover covers the springs from the frame to the bed and a lower spring cover. The lower spring cover attaches to the upper spring cover at a pad to sheath connection.

The pad to sheath connection is on the lower distal end of the upper spring cover. The lower spring cover wraps around a horizontal frame portion of the frame around an outside portion of the horizontal frame portion of the frame. The bed is smaller than the frame such that a gap is formed between the bed and the frame. The springs are helical springs having a spring body with a proximal hook engaging a connector link on the bed. The springs have a distal hook engaging a frame hollow portion of the frame. The distal hook has a distal hook end that inserts into the hollow frame portion.

The lower spring cover is formed as a sheath with a sheath upper part and a sheath lower part. The sheath upper part and the sheath lower part meet at a sheath opening edge. The lower spring cover encapsulates the connector link and the proximal hook. The proximal hook further includes a proximal hook end. Further including a loop swivel opening. The connector link is mounted to a loop swivel. The loop swivel is mounted to the bed.

The lower spring cover attaches between the bed and the springs. The lower spring cover attaches to the bed at sheath inside attachment which is the connection between a sheath upper edge and the bed. The lower spring cover attaches to the springs at a sheath lower edge at a sheath outside attachment. The springs have a spring body with a proximal extension extending toward the bed and a distal extension extending toward the frame. The proximal extension bends downwardly to a proximal bend. The distal extension bends downwardly to pass through a spring connection opening formed on the frame. The proximal bend terminates at a hook end cover. The proximal bend bends upwardly to an upward extending hook. The proximal bend bends back toward the frame at a proximal bend back. The proximal bend back terminates at a proximal hook end that forms a spring biased gate with a spring body barrel edge.

The following call out list of elements can be a useful guide in referencing the element numbers of the drawings.

10 Trampoline
11 Trampoline Enclosure
12 Enclosure Pole
13 Enclosure Support
14 Frame
15 Upper Spring Cover
16 Leg
17 Net
18 Bed
19 Enclosure Pole End Cap
20 Pad
21 Spring Connection Opening
22 Bed Edge
23 Loop Swivel
24 Horizontal Frame Portion
25 Connector Link
26 Connector Link Tip
27 Loop Swivel Extension
28 Peripheral Stitch
29 Frame Hollow Portion
30 Spring
31 Spring Body
32 Distal Hook
33 Proximal Hook
34 Distal Hook End
35 Proximal Hook End
40 Lower Spring Cover
41 Upper Spring Cover Underside
42 Pad To Sheath Connection
43 Lower Spring Cover Proximal Connection
50 Proximal Hook Cover Sheath
51 Sheath Opening Edge
52 Sheath Upper Part
53 Sheath Lower Part
54 Loop Swivel Opening
55 Sheath Upper Edge
56 Sheath Lower Edge
57 Sheath Inside Attachment
58 Sheath Outside Attachment
61 Proximal Extension
62 Proximal Bend
63 Proximal Bend Back
64 Proximal Hook End
65 Hook End Cover
66 Upward Extending Hook Tip
67 Spring Body Barrel Edge
88 Lower Distal End Of The Upper Spring Cover
89 Outside Portion Of The Horizontal Frame Portion

DETAILED DESCRIPTION OF THE EMBODIMENTS

Figure 1:
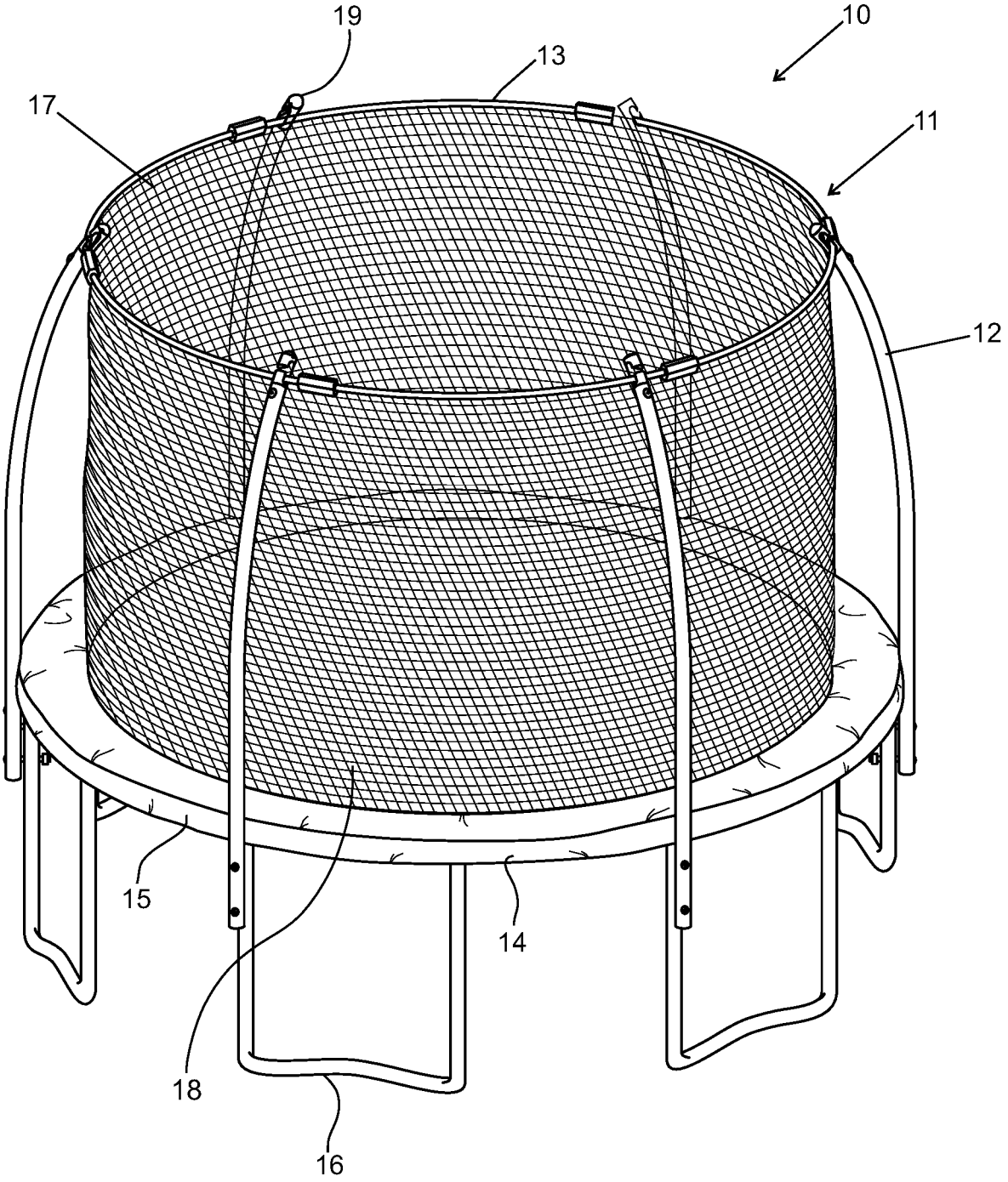
FIG. 1 is a diagram of a trampoline.

As seen in FIG. 1, the trampoline 10 has a trampoline enclosure 11 supported at enclosure poles 12. The enclosure poles 12 raise a net 17 up to an enclosure support 13. The enclosure support 13 is formed as a ring that can support the net 17 at enclosure pole end caps 19. The enclosure pole end caps 19 support the enclosure support 13 which support the net 17. The frame 14 is bolted to the legs 16 and the enclosure poles 12 are bolted to the legs 16 and can also be bolted to the frame 14. The frame 14 suspends a bed 18 and has a peripheral spring cover such as an upper spring cover 15 that covers the frame 14 and springs underneath the upper spring cover 15.

Figure 2:
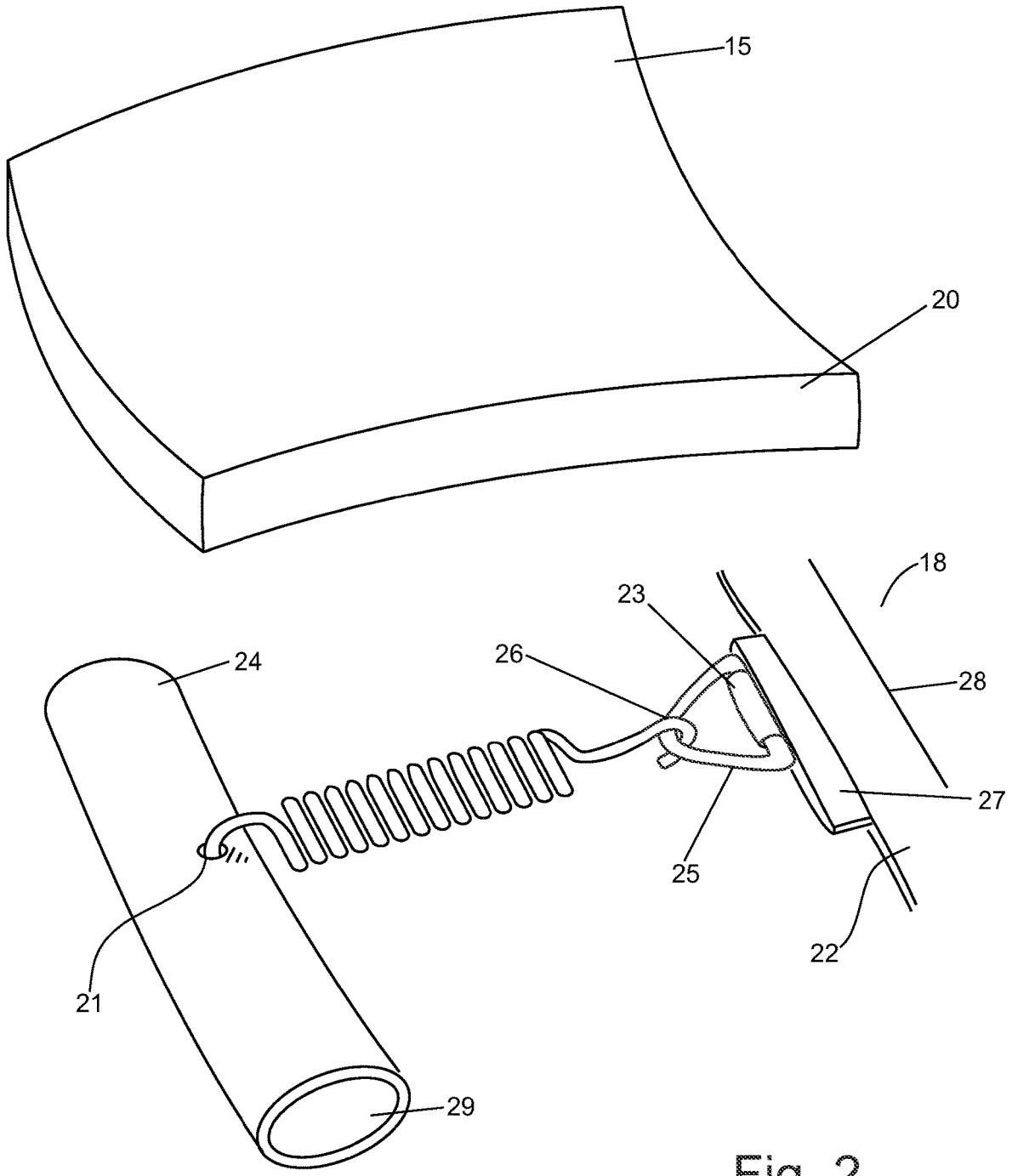
FIG. 2 is an exploded view diagram of a spring connection between a horizontal frame and a bed.

As seen in FIG. 2, the upper spring cover 15 can be formed with a pad 20. The pad 20 can be made of a foam core that can have a fabric cover encapsulating the foam core. The frame hollow portion 29 of the horizontal frame portion 24 increases rigidity of the horizontal frame portion 24 and is located underneath the pad 20. The spring connection opening 21 is also underneath the pad 20. The spring connection opening 21 allows a spring to connect to the horizontal frame portion 24 and extend into the frame hollow portion 29. Additionally, the bed 18 has a peripheral stitch 28 at a bed edge 22. The loop swivel extension 27 is mounted to the bed edge 22. Then, a loop swivel 23 connects to the loop swivel extension 27 and to the connector link 25. The connector link preferably has a connector link tip 26. The pad 20 preferably covers the connector link tip 26, the connector link 25, and the bed edge 22 with at least some overlap of the bed edge 22.

Figure 3:
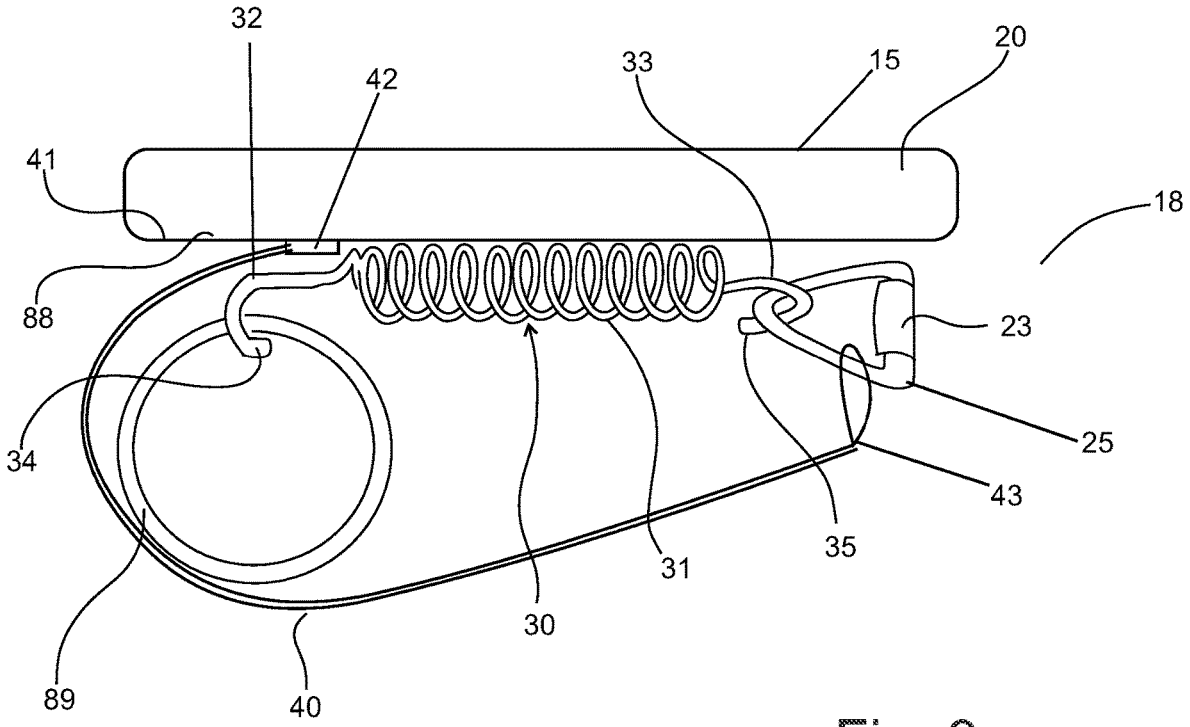
FIG. 3 is a side view diagram of a lower spring cover installation.

As seen in FIG. 3, the pad 20 has an upper portion formed as an upper spring cover 15 and an upper spring cover underside 41. A pad to sheath connection 42 can connect the lower spring cover 42 the upper spring cover 15. The upper spring cover 15 preferably includes a pad 20. The upper spring cover 15 cooperates with the lower spring cover 40 so as to encapsulate the spring 30 and proximal hook end of the spring 30. The lower spring cover 40 can connect to the connector link 25 at a lower spring cover proximal connector 43. The spring 30 extends between a distal hook 32 and a proximal hook 33. The distal hook 32 has a distal hook end 34 which inserts into the spring connection opening 21. The proximal hook 33 has a proximal hook end 35 that hooks over the connector link 25 and connects to the connector link 25. The proximal hook 33 is in tension with the distal hook 32 when the spring 30 is mounted between the horizontal frame and the bed 18.

The upper spring cover 15 can have a multilayer construction. The lower spring cover 40 can also have a multilayer construction having multiple layers of laminated sheet material such as high density polyethylene or high density polyurethane woven fibers. The lower spring cover proximal connector 43 can be formed as a series of multiple loops the loop around the connector link 25.

Figure 4:
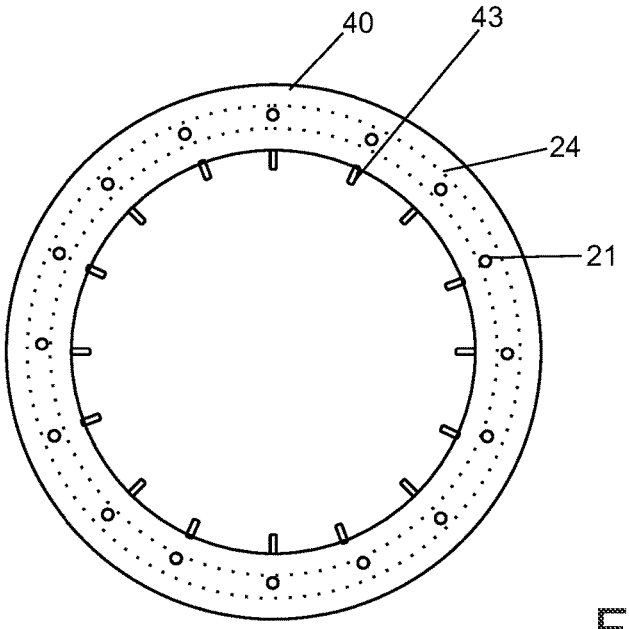
FIG. 4 is a top view of the lower spring cover.

As seen in FIG. 4, the spring connector openings 21 on the horizontal frame portion 24 are covered by the lower spring cover 40. The lower spring cover 40 also has numerous lower spring cover proximal connectors 43 that attached to each one of the springs 30. The numerous lower spring cover proximal connectors 43 extending inwardly from the annular profile of the lower spring cover 40.

Figure 5:
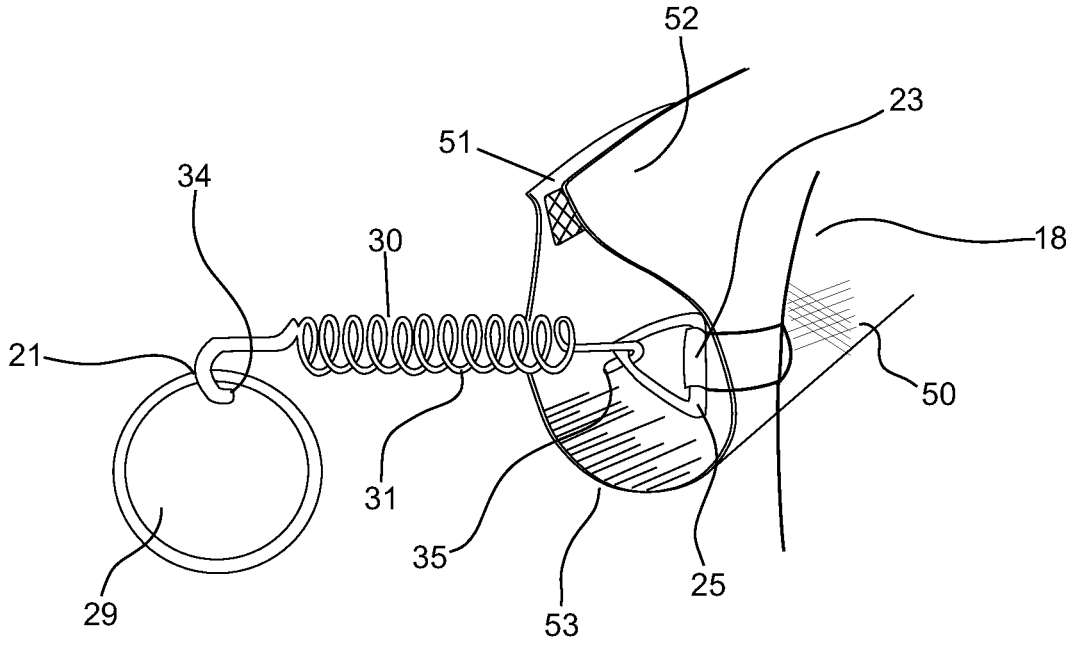
FIG. 5 is an exploded cross-section view of the present invention.

As seen in FIG. 5, the spring 30 has a spring body 31. The spring 30 has a distal hook end 34 which is further away from the bed and a proximal hook end 35 closer to the bed. The spring 30 hooks onto the spring connection opening 21 entering the frame hollow portion 29. The spring 30 also hooks onto the connector link 25. A proximal hook cover sheath 50 has a sheath upper part 52 and a sheath lower part 53. The sheath covers the proximal hook end 35 and has a sheath opening edge 51. The bed 18 has a loop swivel 23 that retains the connector link 25. The proximal hook cover sheath 50 covers the proximal hook end 35.

Figure 6:
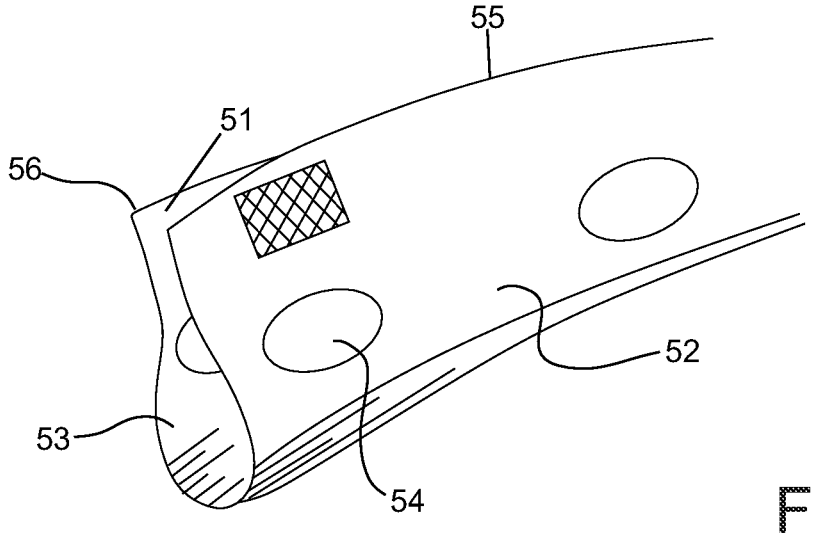
FIG. 6 is a diagram showing construction of the proximal hook cover sheath.

As seen in FIG. 6, the proximal hook cover sheath 50 has a sheath upper edge 55 and a sheath lower edge 56 at a sheath opening edge 51. The spring 30 passes through the sheath opening edge 51 and the loop swivel 23 passes through the loop swivel opening 54. The sheath upper part 52 overlies the sheath lower part 53. The sheath upper part 52 preferably is continuous to the sheath lower part 53 such that both are made of a single long sheet of plastic fabric material such as woven polypropylene.

Figure 7:
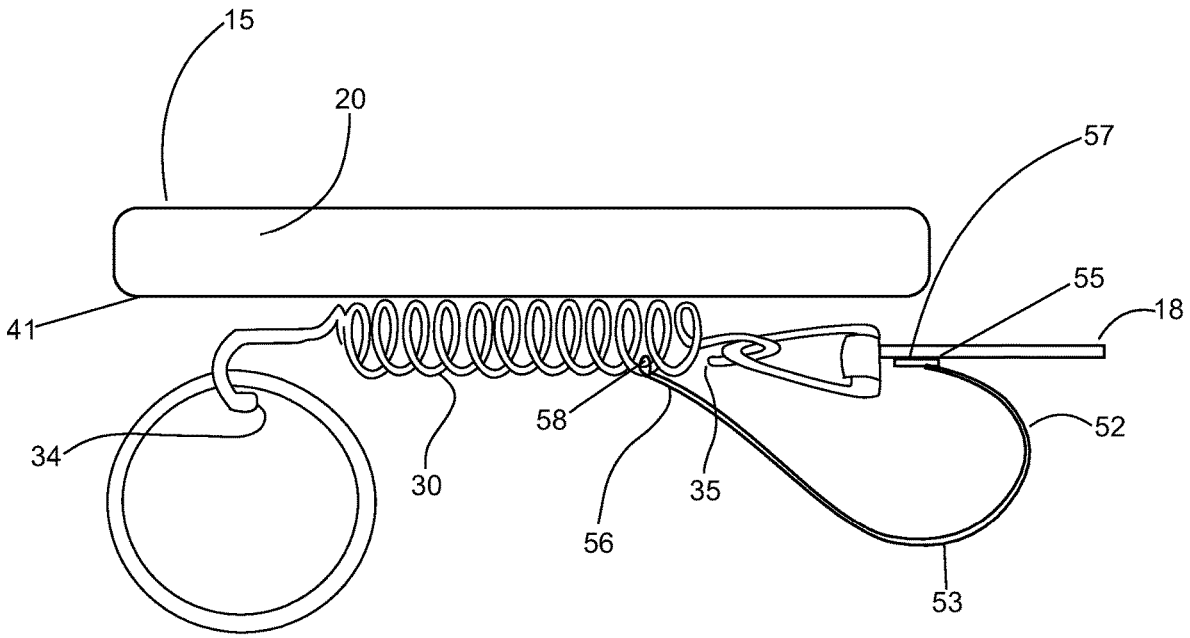
FIG. 7 is a side cross-section diagram of the hook cover sheath installed over a proximal hook end of a spring.

As seen in FIG. 7, the upper spring cover and the lower spring cover can cooperate without being directly connected to each other. For example, the lower spring cover can have the sheath lower part 53 that extends to a sheath upper part 52, where the sheath upper part 52 is connected to a sheath inside attachment 57 on an underside of a bed 18. The sheath inside attachment 57 also preferably has a sheath upper edge 55.

The sheath lower edge 56 extends past the proximal hook end 35 and connects to the sheath outside attachment 58 on the spring 30. The sheath upper edge 55 attaches to the sheath under inside attachment 57 on the bed 18. The upper spring cover 15 having a pad 20 cooperates with the lower spring cover so as to encapsulate the proximal hook end 35.

Figure 8:
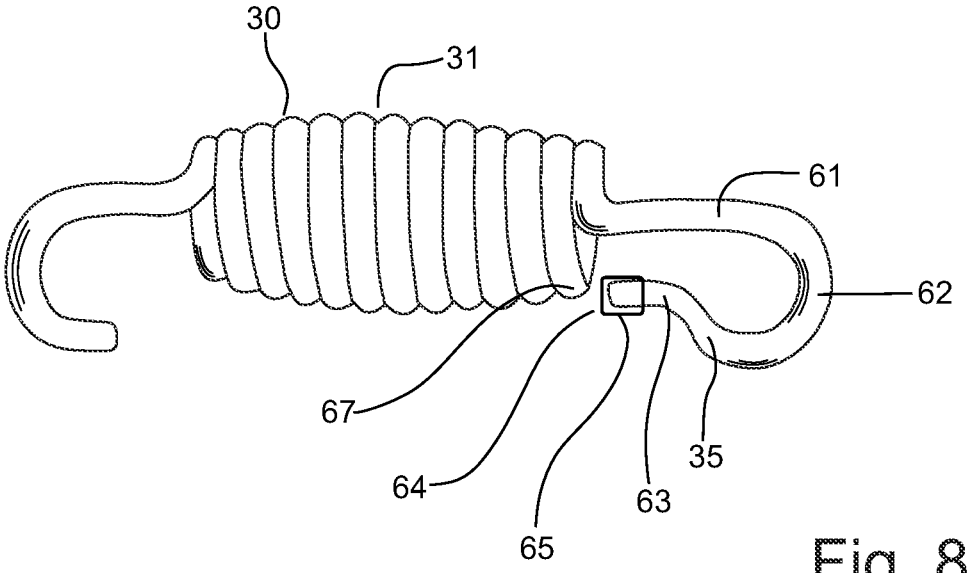
FIG. 8 is a diagram showing a spring with a proximal bend back configuration.
Figure 13:
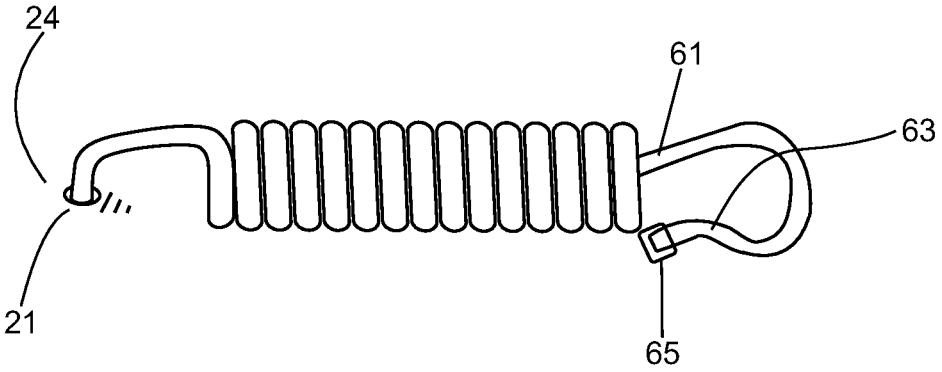
FIG. 13 is a diagram showing an installed spring with a proximal bend back configuration.

As seen in FIGS. 8 and 13, the spring 30 has a barrel shaped spring body 31. The proximal extension 61 extends worth a proximal bend 62. The hook end cover 65 fits over the proximal hook end 64. The proximal hook end 64 extends outwardly from a proximal bend back 63. The proximal bend back bends from the proximal bend 62 in an orientation opposite the proximal bend 62. The proximal bend back 63 is preferably parallel to the proximal extension 61. The proximal bend back 63 orients the proximal hook end 64 such that it forms a gate with the spring body barrel edge 67. The gap between the proximal hook end 64 and the spring body barrel edge 67 provides a retention means for retaining the connector link 25. As seen in FIG. 13, the proximal bend back 63 can be at an angle which brings the hook end cover closer to the spring body barrel edge 67.

Figure 9:
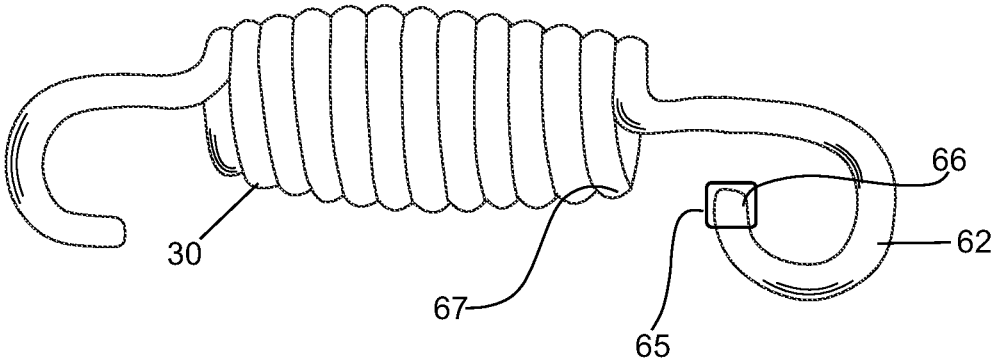
FIG. 9 is a diagram showing a spring with an upward extending hook tip configuration.
Figure 12:
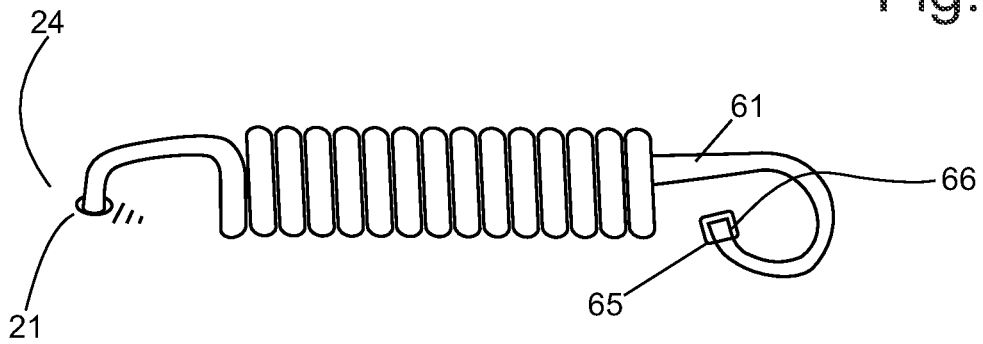
FIG. 12 is a diagram showing an installed spring with an upward extending hook tip.

As seen in FIGS. 9 and 12, the spring 30 has a spring body that has a barrel shape. The spring 30 also has a spring body barrel edge 67. Instead of a proximal bend back 63, the proximal bend 62 can extend to an upward extended hook tip 66. The upward extended hook tip 66 is perpendicular to the proximal extension 61. As seen in FIG. 12, the upwardly extending hook 66 can terminate before being completely perpendicular to the proximal extension 61. The hook end cover 65 can be pointing towards the spring body barrel edge 67.

Figure 10:
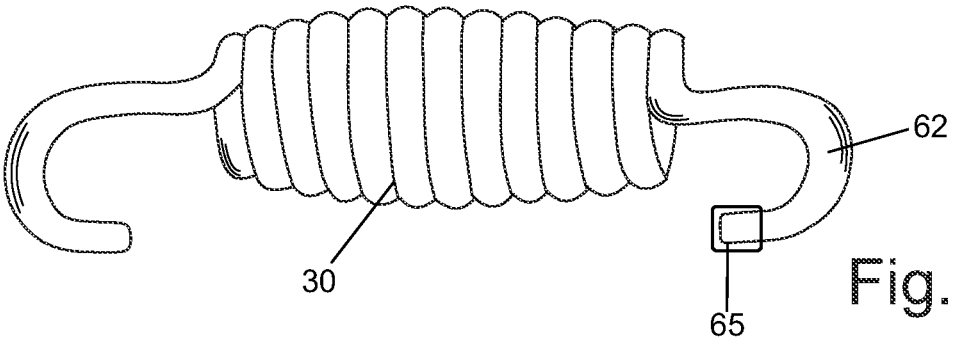
FIG. 10 is a diagram showing the spring with a hook end cover.
Figure 11:
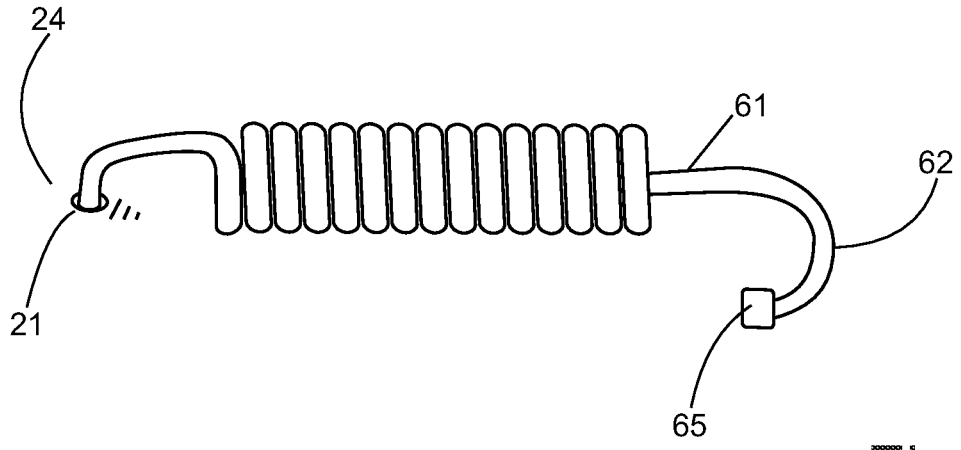
FIG. 11 is a diagram showing an installed spring with a hook end cover.

As seen in FIGS. 10-11, the spring 30 has a proximal bend 62 that terminates at a hook end cover 65. As seen in FIG. 11, the proximal bend 62 can be a larger or smaller diameter, and may have a complete hook end cover 65. The other end of the spring 30 hooks to the spring connection opening 21 on the horizontal frame portion 24.

The hook end cover can be made of an elastomeric material such as a high density polyethylene bead of plastic that is formed to the proximal hook tip. The lower distal end of the upper spring cover 88 is formed as an annular portion around the upper spring cover 15. The lower distal end of the upper spring cover 88 is preferably adjacent to the outside portion of the horizontal frame portion of the frame 89.

The invention claimed is:

1. A trampoline:

a. a frame, wherein the frame is horizontally oriented;

b. legs, wherein the legs attach to the frame, and wherein the legs support the frame;

c. a bed, wherein the bed is suspended across the frame;

d. springs connecting the frame to the bed, wherein the springs are in tension and stretch the bed across the frame;

e. an upper spring cover, wherein the upper spring cover covers the springs from the frame to the bed, wherein the upper spring cover covers the upper side of the springs; and f. a lower spring cover, wherein the lower spring cover is underneath the springs and covers a lower side of the springs, wherein the upper spring cover includes a pad, wherein the lower spring cover attaches to the upper spring cover at a pad to sheath connection.

2. The trampoline of claim 1, wherein the pad to sheath connection is on the lower distal end of the upper spring cover.

3. The trampoline of claim 2, wherein the lower spring cover wraps around a horizontal frame portion of the frame around an outside portion of the horizontal frame portion of the frame.

4. The trampoline of claim 3, wherein the springs are helical springs having a spring body with a proximal hook engaging a connector link on the bed, and wherein the springs have a distal hook engaging a frame hollow portion of the frame, wherein the distal hook has a distal hook end that inserts into the hollow frame portion.

5. The trampoline of claim 4, wherein the spring body has a proximal extension extending toward the bed and a distal extension extending toward the frame, wherein the proximal extension bends downwardly to a proximal bend, and wherein the distal extension bends downwardly to pass through a spring connection opening formed on the frame.

6. The trampoline of claim 5, wherein the proximal bend terminates at a hook end cover.

7. The trampoline of claim 6, wherein the proximal bend bends upwardly to an upward extending hook.

8. The trampoline of claim 7, wherein the proximal bend bends back toward the frame at a proximal bend back.

9. The trampoline of claim 8, wherein the proximal bend back terminates at a proximal hook end that forms a spring biased gate with a spring body barrel edge.

10. A trampoline:

a. a frame, wherein the frame is horizontally oriented;

b. legs, wherein the legs attach to the frame, and wherein the legs support the frame;

c. a bed, wherein the bed is suspended across the frame;

d. springs connecting the frame to the bed, wherein the springs are in tension and stretch the bed across the frame;

e. an upper spring cover, wherein the upper spring cover covers the springs from the frame to the bed, wherein the upper spring cover covers the upper side of the springs; and f. a lower spring cover, wherein the lower spring cover is mounted underneath the springs and completely covers a lower side of the springs all the way from the frame to the bed, wherein the bed is smaller than the frame such that a gap is formed between the bed and the frame.

11. The trampoline of claim 10, wherein the springs are helical springs having a spring body with a proximal hook engaging a connector link on the bed, and wherein the springs have a distal hook engaging a frame hollow portion of the frame, wherein the distal hook has a distal hook end the inserts into the hollow frame portion.

12. The trampoline of claim 11, wherein the springs have a spring body with a proximal extension extending toward the bed and a distal extension extending toward the frame, wherein the proximal extension bends downwardly to a proximal bend, and wherein the distal extension bends downwardly to pass through a spring connection opening formed on the frame.

13. The trampoline of claim 12, wherein the proximal bend terminates at a hook end cover.

14. The trampoline of claim 13, wherein the proximal bend bends back toward the frame at a proximal bend back.

15. The trampoline of claim 14, wherein the proximal bend back terminates at a proximal hook end that forms a spring biased gate with a spring body barrel edge.

16. The trampoline of claim 13, wherein the proximal bend bends upwardly to an upward extending hook.

17. The trampoline of claim 11, wherein the lower spring cover is formed as a sheath with a sheath upper part and a sheath lower part, wherein the sheath upper part and the sheath lower part meet at a sheath opening edge, wherein the lower spring cover encapsulates the connector link and the proximal hook, wherein the proximal hook further includes a proximal hook end.

18. The trampoline of claim 17, further including a loop swivel opening, wherein the connector link is mounted to a loop swivel, wherein the loop swivel is mounted to the bed.

19. The trampoline of claim 11, wherein the lower spring cover attaches between the bed and the springs, wherein the lower spring cover attaches to the bed at sheath inside attachment which is the connection between a sheath upper edge and the bed, and wherein the lower spring cover attaches to the springs at a sheath lower edge at a sheath outside attachment.

* * * * *